United States Patent [19]

Henson

[11] 4,081,040

[45] Mar. 28, 1978

[54] METHOD AND APPARATUS FOR THIN-WALLED TUBE SAMPLING OF SOILS

[75] Inventor: William P. Henson, Indianapolis, Ind.

[73] Assignee: Mobile Drilling Company, Inc., Indianapolis, Ind.

[21] Appl. No.: 794,530

[22] Filed: May 6, 1977

[51] Int. Cl.[2] ..... E21B 49/02; E21B 23/02

[52] U.S. Cl. ..... 175/58; 175/246

[58] Field of Search ..... 175/58, 246, 244, 248, 175/323, 162

[56] References Cited

U.S. PATENT DOCUMENTS

| | | | |
|---|---|---|---|
| 1,456,983 | 5/1923 | Hansen | 175/244 X |
| 1,830,685 | 11/1931 | Wellensick | 175/246 |
| 3,095,051 | 6/1963 | Robinsky et al. | 175/248 X |
| 3,120,282 | 2/1964 | Pickard | 175/247 X |
| 3,241,624 | 3/1966 | Rassieur | 175/246 X |
| 3,295,616 | 1/1967 | Charlton et al. | 175/58 X |
| 3,794,127 | 2/1974 | Davis | 175/58 |
| 3,870,112 | 3/1975 | Castel et al. | 175/247 X |
| 3,977,482 | 8/1976 | Reed et al. | 175/246 |

*Primary Examiner*—Stephen J. Novosad

*Attorney, Agent, or Firm*—Woodard, Weikart, Emhardt & Naughton

[57] ABSTRACT

An open-spindle earth sampling apparatus for taking and retrieving core samples of coil comprising a drilling apparatus having rotary power means, a hollow auger section, a hollow-centered drive shaft connected to the drilling apparatus, a gimbal ring auger coupling and a sampling device suspended into the hollow auger section by means of a reelable hoist cable. The hoist cable is attached between the drilling apparatus and the sampling device and the gimbal ring auger coupling bearingly connects the hollow auger section to the drive shaft. The sampling device includes a rotatable locking portion and a pivotally-stationary, thin-walled sampling tube which is bearingly connected to the rotatable locking portion. The rotatable locking portion is rigidly secured to the hollow auger by a pair of expandable latches such that the thin-walled sampling tube projects from the end of the hollow auger. As the hollow-centered drive shaft rotates about its axis, the hollow auger section rotates about its axis imparting a downwardly advancing motion to the thin-walled sampling tube. Concurrent with this advancing motion a hydraulic feed system, connected to the rotary power means, exerts a downward force on the thin-walled sampling tube which penetrates the soil at the bottom of the drilled hole with a rapid and continuous motion and a core sample is thus obtained within the sampling tube. Once the core sample is taken, the latches are released and the sampling mechanism is drawn out of the hollow auger section by means of the reelable hoist cable.

6 Claims, 8 Drawing Figures

METHOD AND APPARATUS FOR THIN-WALLED TUBE SAMPLING OF SOILS

BACKGROUND OF THE INVENTION

1. Field of the Invention

This invention relates in general to earth drilling devices and methods and in particular to core sampling devices and methods.

2. Description of the Prior Art

Earth drilling machines which incorporate the use of core sampling equipment are well known for taking geological samples of earth layers. One method of obtaining a core sample has traditionally involved attaching a drill bit device to the spindle of a drilling machine, drilling a hole in the earth and then forcing a sampling tube into the earth at the bottom of the drill hole. This method is satisfactory when the depth of the drilled hole is shallow inasmuch as only one or two drill sections may have to be attached in order to reach the desired depth. However, for deeper holes a series of drill sections have to be connected together, then prior to taking a sample, a sampling tube is lowered into the drilled hole by means of drill rods which must be threaded together to extend the depth of the hole. The activity of threading the drill rods together and then taking them apart when the core sample is retrieved from the hole results in a considerable amount of time being spent in handling the rods.

One solution to this problem of having to connect and disconnect a series of drill rods each time the sampling tube is lowered into and retrieved from the hole is provided by the open spindle concept which allows the sampling tube to be lowered through a series of hollow drill sections into the hole by means of a reelable hoist cable. The device of Davis, U.S. Pat. No. 3,794,127 discloses such an open spindle drilling machine which uses an auger style drilling section which has a helical flight for bringing soil from the bottom of the hole to the surface. Once the hole is drilled to the desired depth, a sampling tube is lowered through the hollow auger sections to the bottom of the hole and is driven into the earth by means of a hammer which is lowered to repeatedly strike the top of the sampling tube.

Related open-spindle drilling devices are disclosed by the patents of Frenzel, U.S. Pat. No. 2,145,170; Kinnear, U.S. Pat. No. 2,251,679; Pickard, U.S. Pat. No. 3,120,282; Wolda, U.S. Pat. No. 3,739,865; and Sweeney, U.S. Pat. No. 3,893,524. Each of these devices allows the operational advantage of being able to position the sampling tube at the bottom of the drilled hole without having to connect and disconnect a series of drill rods. However, these referenced devices are limited by their construction to core sampling of rock or solid soil formations. Such devices are not suitable for taking and retrieving of relatively undisturbed soil samples suitable for laboratory tests according to ASTM Designation: D1587–67. This ASTM designation requires that a thin-walled tube be used and that the tube be inserted into the soil with continuous and rapid penetration and without impact or twisting. In each of the referenced devices, the sampling tube is attached to the drill section in such a way that as the drill section rotates, the sampling tube also rotates and thus, there is a twisting motion as the tube enters the soil being sampled and consequently, such devices are not suitable to obtain a relatively undisturbed soil sample as the ASTM designation requires.

The devices of Hansen, U.S. Pat. No. 1,456,983 and Castel et al., U.S. Pat. No. 3,870,112 are designed in such a way as to be usable for taking relatively undisturbed soil samples. Hansen incorporates an outer drilling tube bearingly mounted around an inner sampling tube. The outer drilling tube has a spiral conveyor formed on its inner wall for removing debris as the drill bit rotates and the inner sampling tube is nonrotatable. The disadvantage with both Hansen and Castel is that neither device uses an open-spindle design. Consequently, the taking of a sample with the Hansen and Castel devices is a relatively complicated and time-consuming procedure.

SUMMARY OF THE INVENTION

One embodiment of the apparatus of the present invention involves a drilling apparatus having a rotary power means, an auger section including a hollow tube, a hollow-centered drive shaft, a hollow-centered coupling connecting the drive shaft to the auger section, a sampling device including a locking element and a thin-walled sampling tube, reelable cable means connecting the drilling apparatus and the locking element, and a latching mechanism on the locking element and the hollow tube. The locking element is bearingly connected to the thin-walled sampling tube such that as the locking element rotates, the sampling tube remains pivotally stationary. The latching mechanism is operable to rigidly secure the locking element of the sampling device to the hollow tube. Continued rotation of the auger section downwardly advances the pivotally-stationary, thin-walled sampling tube forcing the tube into the soil at the bottom of the drilled hole.

One embodiment of the method of the present invention comprises the following steps. First, a drilling apparatus is positioned at a drilling site. Further steps involve connecting a hollow driver to the drilling apparatus, connecting a hollow stem auger, with a drill bit plug inserted, to the hollow driver, and operating the drilling apparatus to rotate the hollow stem auger and drill a hole into the earth. After the hole is drilled, further steps include removing the drill bit plug, unreeling a reelable hoist cable to insert a sampling device through the hollow driver locking the sampling device into the auger, taking a core sample from the bottom of the drill hole by rotating the auger while pressing down with a hydraulic feed system and reeling in the hoist cable to retrieve the core sample.

One object of the present invention is to provide an improved drilling apparatus for retrieval of a core sample of relatively undisturbed soil.

Another object of the present invention is to provide an improved method of retrieving a core sample of relatively undisturbed soil.

Related objects and advantages of the present invention will be apparent from the following description.

DESCRIPTION OF THE PREFERRED EMBODIMENTS

Figure 1:
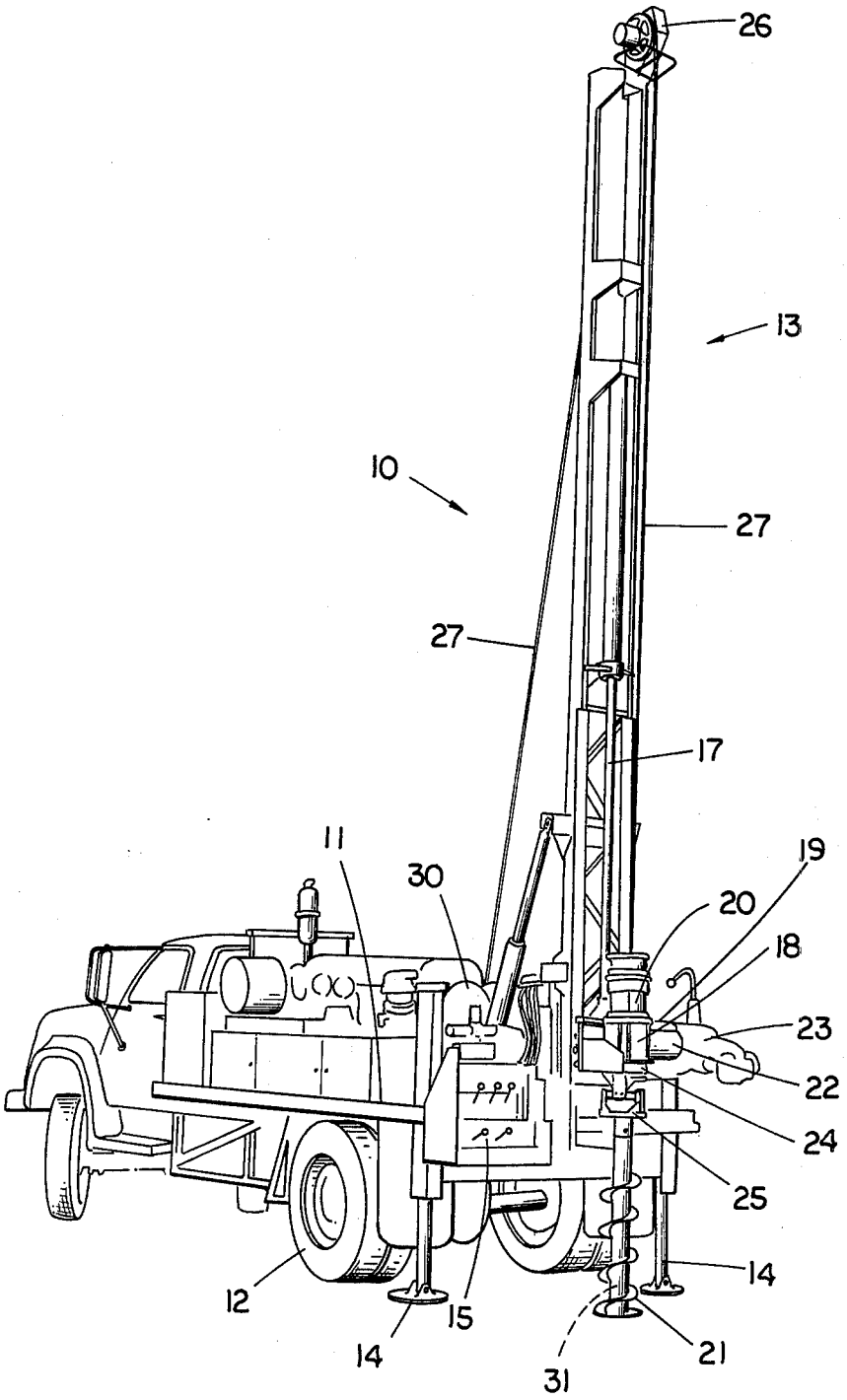
FIG. 1 is a perspective view of an earth sampling apparatus according to the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a perspective view of an earth sampling apparatus 10 which has a platform 11 mounted to a frame of a truck extending over the rear wheels 12 thereof. A mast 13, shown in a vertically-erect position, is secured to the platform. To increase the mobility of the apparatus, the mast 13 may be retracted to a generally-horizontal position over the cab of the truck. Stabilizers 14 are extended downward from platform 11 to provide a stabile platform during the drilling and sampling operations. Various controls 15 are provided to control the rotation and vertical movement of the auger and sampling device. Rotary head driver 18, which rotates hollow spindle 20, is attached to transmission unit 23 by means of gear housing 22, and these four drive components are supported by a lateral shift table 19. Shift table 19 is mounted to platform 11 and is movable laterally to position the auger above the desired drilling site. Hydraulic feed system 17, which comprises a hydraulic cylinder and piston, attaches between mast 13 and lateral shift table 19. Hydraulic feed system is operable to raise and lower lateral shift table 19 and is thereby operable to exert a downward force on rotary head driver 18. The top end of the auger section 21 is connected to the bottom end 24 of spindle 20 by gimbal ring auger coupling 25. The rotary head driver 18 and spindle 20 are advanced downward along the length of mast 13 so as to advance the auger into the hole. Eventually, the auger is advanced sufficiently downward, as shown in FIG. 1, so that in order to continue to drill deeper, the top end of the auger section must be disconnected from coupling 25 so that a new section of auger can be inserted and connected between the first auger section 21 in the hole and the coupling 25. Of course, the rotary head driver 18 and spindle 20 are advanced vertically upward along mast 13 when a new auger section is required, and then lowered when the drilling resumes.

A wheel or pulley 26 sometimes called a crown sheave is rotatably mounted to the top of mast 13 and receives a wire or cable 27 which is attached to an earth sampling device 31 (not shown) which is suspended within auger section 21. The opposite end of cable 27 is wound on drum 30 mounted atop platform 11. Drum 30 may be rotated so as to raise and lower earth sampling device 31 through auger section 21.

Figure 2:
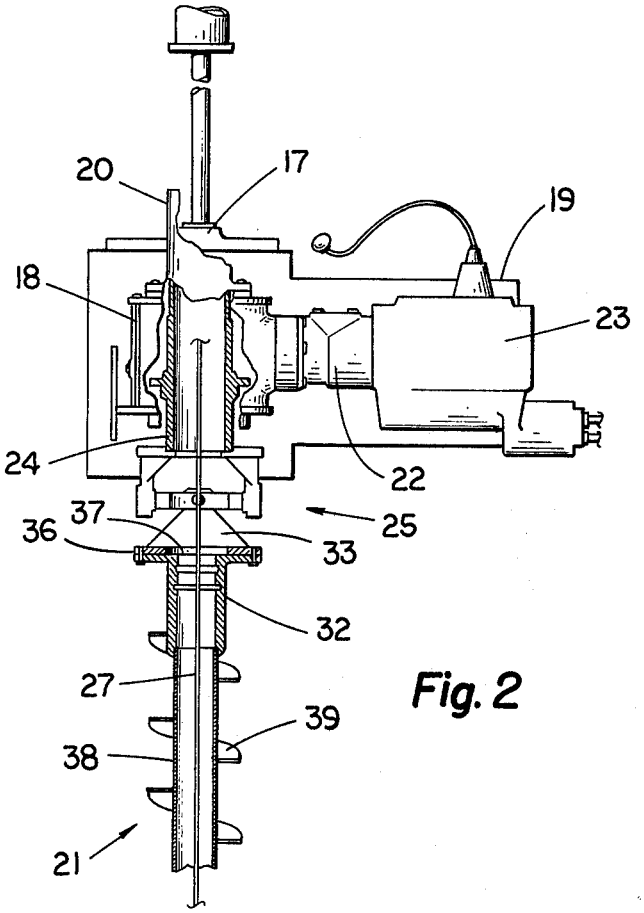
FIG. 2 is a fragmentary elevational view of a rotary head driver, spindle and coupling comprising a portion of the FIG. 1 apparatus.

FIG. 2 is a fragmentary elevational view showing in greater detail rotary head driver 18, gear housing 22 and transmission unit 23 mounted to lateral shift table 19. Hydraulic feed system 17 connects to shift table 19 as has been described, and gimbal ring auger coupling 25 attaches to the lower end 24 of spindle 20. The combination of driver 18, housing 22 and transmission unit 23 is a commercially-available apparatus and may be, for example, a Mobile Model B-53 manufactured by Mobile Drilling Co., Inc. of Indianapolis, Indiana. The Model B-53 is provided with an Open Drill Spindle 4.625 inches I.D. which is spindle 20. Cable 27 extends from drum 30 over wheel 26 (see FIG. 1) through the hollow spindle 20 and through coupling 25 and is attached to sampling device 31 (see FIG. 4). Annular member 32 is internally threaded at its lower end and its upper end is bolted to a lower yoke 33 which includes plate 36 which has a cylindrical opening 37 concentric to auger section 21 and through which cable 27 passes. The internally-threaded lower end of member 32 is attached to the top of auger section 21. Auger section 21 is constructed of a hollow tube 38 with a helical flight 39 secured to the periphery of tube 38 by welding or other suitable means in such a way that as auger section 21 rotates and drills into the earth, particles of soil at the bottom of the hole being drilled are brought to the surface by way of helical flight 39.

Figure 3:
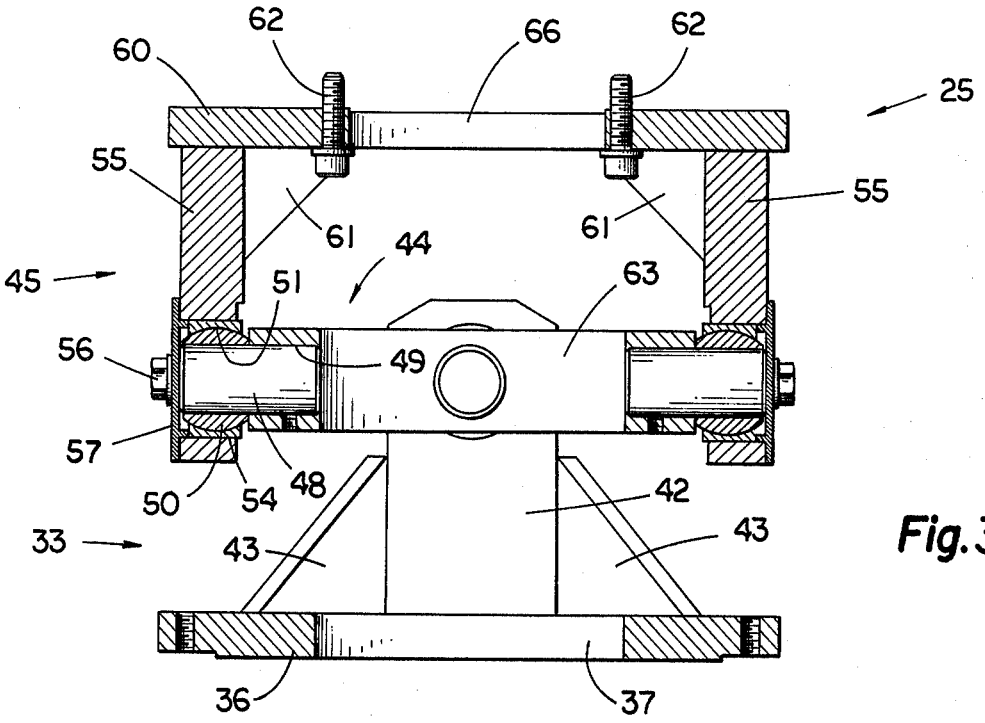
FIG. 3 is a fragmentary, detailed elevational view of the coupling illustrated in FIG. 2.

FIG. 3 is a fragmentary view of the gimbal ring auger coupling 25 showing the component parts in greater detail. Fixed to plate 36 are two upright members 42 which are parallel to each other, 180° apart and braced by four supporting members 43 positioned 90° apart. Lower yoke 33 is pivotally connected to a cross member 44 which is pivotally connected to the upper yoke 45. These pivotal connections are achieved by the use of bearings and the bearing connection of the upper yoke 45 to the cross member 44 is identical to the connection between the lower yoke 33 and the cross member 44 and will be described as representative. The cross member 44 has an externally-octagonal configuration and an internally-cylindrical configuration. A pin 48 is press-fit in each of the bores 49. The pin 48 has bearing 50 push-fitted thereon. Bearing 50 rides within bearing 51 press-fitted within the bore 54 in both depending members 55. Cap screws 56 are attached to the depending members 55 and secure retainer cap 57 in position. The depending members 55 are fixed to plate 60 and braced by support members 61 which are connected to the plate 60 and the depending members 55. The upper yoke 45 including plate 60 is fixed to the lower end 24 of spindle 20 by bolts 62. Both the cross member 44 and plate 60 have large cylindrical openings 63 and 66, respectively, concentric to each other and to spindle 20. The design of gimbal ring auger coupling 25 gives substantial freedom of pivoting movement in all directions but it also provides by means of openings 37, 63 and 66 an open center through which objects may be passed.

Figure 4:
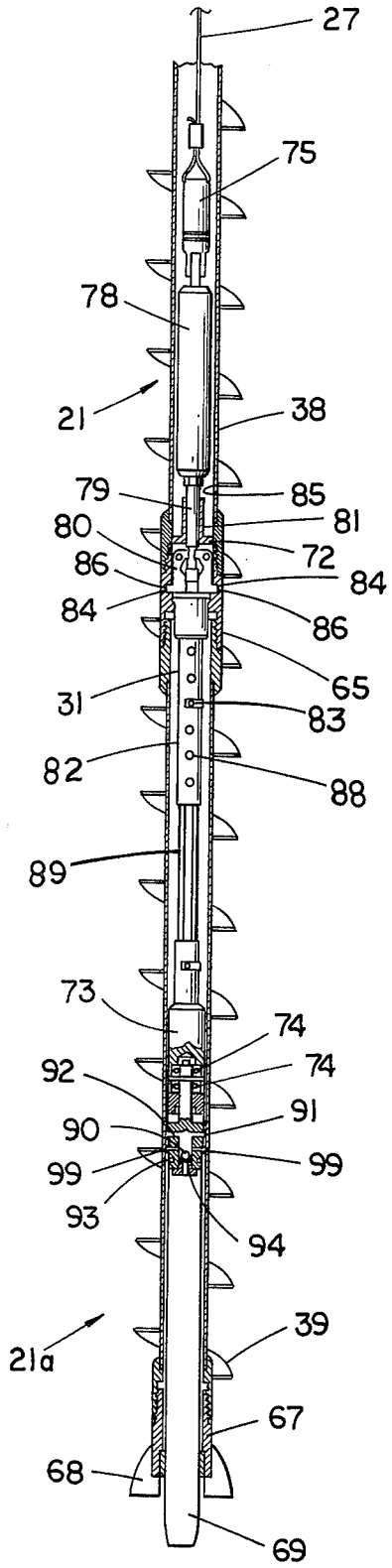
FIG. 4 is a fragmentary elevational view of a hollow auger and sampling device comprising a portion of the FIG. 1 apparatus.

FIG. 4 is a fragmentary elevational view of a sampling device 31 suspended through a pair of auger sections 21 and **21*a* by means of cable 27. The two auger sections are joined end to end with each other by means of connector 65 which includes means for locking the sampling device into position. This locking procedure will be described below. As has been previously described, upper auger section 21 is attached to annular member 32 at one end. On the distal end of auger section 21*a*, cutter head 67 is located. Cutter head 67** extends for several inches beyond the end of helical flight 39 and includes a pair of tungsten carbide cutter plates 68 which are bolted into postion.

Sampling device 31 includes a locking portion 72 at one end and a thin-walled sampling tube 69 at the other end which extends a few inches beyond the end of cutter plates 68. Locking portion 72 and sampling tube 69 are connected to one another by means of bearing housing 73 which supports a pair of thrust bearings 74. This bearing housing 73 permits locking portion 72 to rotate about its axis in response to rotation of the auger sections 21, 21*a*, while thin-walled sampling tube 69 remains pivotally stationary. Locking portion 72 includes latch plunger 79, latches 80, guide 81, locking cylinder 82 and U-pin spring clip 83. Attached between latch plunger 79 and cable 27 are two additional components, ball bearing swivel 75 and weight 78, which cooperate with cable 27 to cause locking portion 72 to lock into position. Latch plunger 79 is aligned by guide 81 and cooperates with the pair of latches 80 to secure locking portion 72 into connector 65. As the sampling device 31 is lowered through auger sections 21 and 21*a* by means of cable 27, an upward pull is exerted on latch plunger 79 which causes latches 80 to pivot into a retracted position. They are held there until a stop is reached near the approximate midpoint of connector 65. At this location the tips 84 of latches 80 are in line with recesses 86. Weight 78 continues to downwardly exert a force on plunger 79 and this force causes plunger 79 to expand latches 80 outwardly thereby allowing tips 84 to lock into recesses 86. With the latches 80 locked into connector 65, locking portion 72 will rotate about its axis when auger section 21 is rotated about its axis by rotary head driver 18. Retraction of cable 27 causing a lifting force in an upward direction frees latches 80 so the sample can be retrieved.

Locking cylinder 82 which acts as the connection between locking portion 72 and bearing housing 73 has a series of openings 88 into which a suitable U-pin spring clip 83 is inserted to retain the hex bar portion 89 of sampling device 31. The locking cylinder 82 and U-pin spring clip 83 are well known in the art and further details of the mechanical features are not thought necessary. It should be noted that with several openings 88, the length of protrusion of tube 69 beyond cutter plates 68 is adjustable.

A check ball valve 90 and vent holes 91 are located in the head assembly 92 of sampling tube 69 to permit air to escape as the soil sample enters the sampling tube. An "O-ring" 93 between head assembly 92 and sampling tube 69 and a rubber seat 94 under check ball valve 90 create sufficient suction to retain water-saturated soils and silts. Sampling tube 69 is attached to head assembly 92 by means of cap screws 99.

Figure 5:
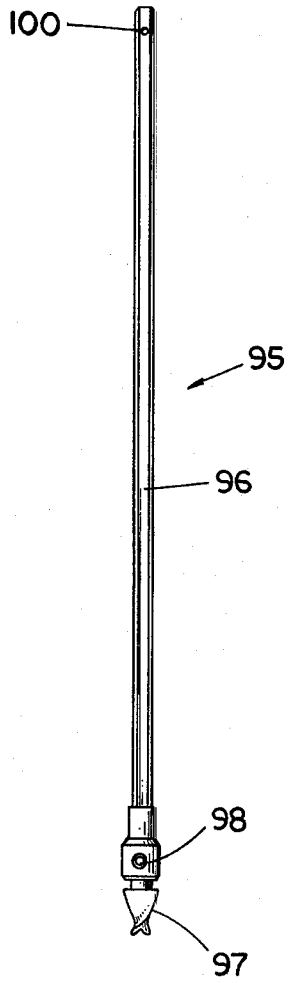
FIG. 5 is an elevational view of a drill bit plug associated with the FIG. 1 apparatus.

FIG. 5 is an elevation view of a drill bit plug 95 which includes a pilot bit 97 which is attached to the end of hex bar member 96 by cap screw 98. Drill bit plug 95 is inserted into the leading auger section 21*a* and secured thereto when it is required to drill a hole in the earth. Associated with the use of drill bit plug 95 are all the mechanical components extending between cable 27 and hex bar 89 (see FIG. 4) and whose features have previously been described. Drill bit plug 95 attaches into locking cylinder 82 by means of opening 100 into which U-pin spring clip 83 is inserted. The operation of the latches 80 and the locking into connector 65 of locking portion 72 as has been described for FIG. 4, is representative of how drill bit plug 95 is lowered into augers 21 and 21*a* and is locked into position for drilling. As the hole is drilled, the soil being removed is kept out of the lead auger, due to the shape of pilot bit 97, and this soil passes up to the surface by way of helical flight 39. Once the desired depth is reached, drill bit plug 95 is withdrawn from the leading auger section 21*a* by reeling in cable 27 thereby freeing latches 80 from connector 65. Then, the drill bit plug 95 is replaced by sampling device 31 which is inserted into auger section 21*a* and is then operated as has been previously described.

Figure 6:
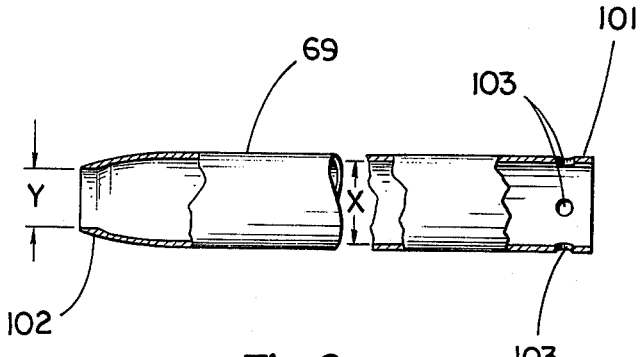
FIG. 6 is a fragmentary plan view of a thin-walled sampling tube comprising a part of the sampling device illustrated in FIG. 4.

FIG. 6 is a fragmentary plan view of thin-walled sampling tube 69 showing the shape and construction of end 102 which is the end that is forced into the soil with rapid and continuous penetration by means of auger sections 21 and 21*a*. Sampling tube 69 is designed to conform in all respects to ASTM Designation. D1587-67 which outlines the Standard Method for Thin-Walled Tube Sampling of Soils. In accordance with the ASTM designation, the inside clearance ratio computed by the expression $(X-Y/Y)$ 100 shall be between 0.5% and 3%. The wall thickness recommendations are a function of the outside diameter of the sampling tube and the length of the sampling tube 69 is determined by field conditions. Four mounting holes 103 spaced 90° apart are located at least one inch from end 101 and are required for attachment of sampling tube 69 to head assembly 92.

Figure 7:
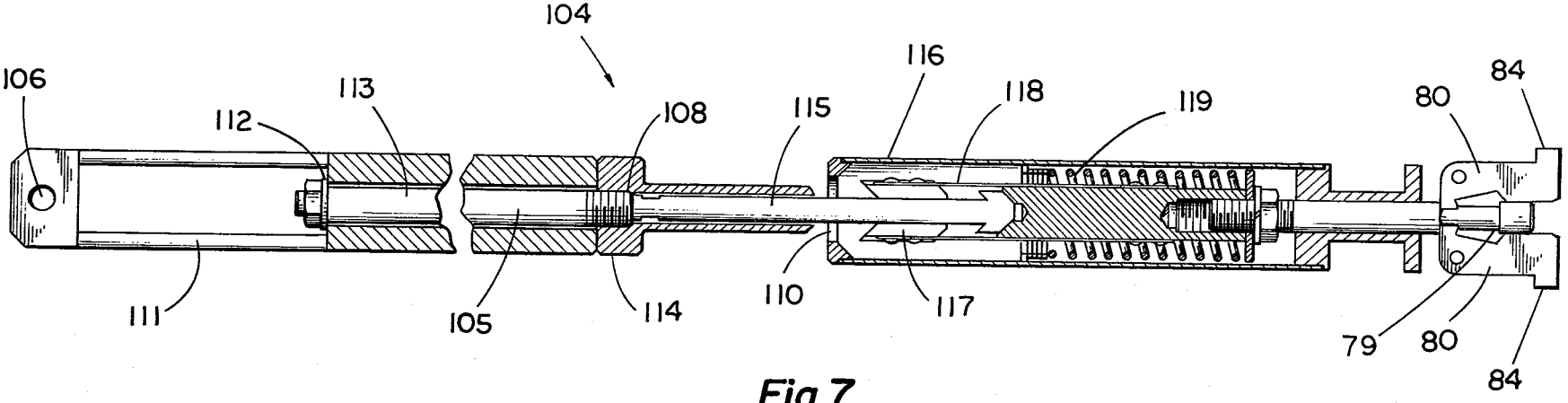
FIG. 7 is a fragmentary elevational view of an overshot mechanism in a retrieval mode.

FIG. 7 is a fragmentary elevation of an overshot mechanism 104 in a retrieval mode which can be used in lieu of the combination of weight 78 and guide 81. When used, overshot mechanism 104 allows cable 27 to be disconnected from sampling device 31 (or drill bit plug 95) once the sampling device is secured to auger section 21*a*. Similarly when a soil sample is ready to be retrieved, cable 27 can be reattached to sampling device 31 (or drill bit plug 95) by means of overshot mechanism 104.

Overshot mechanism 104 has a center cylindrical spear 105 which consists of stem 113 attached to probe 115. Stem 113 is both externally threaded and internally threaded at end 108 where probe 115 is inserted into stem 113. Weighted member 111 and plug 114 are free to slide over stem 113 and probe 115 so long as plug 114, which is internally threaded at one end, is not threadedly attached to the externally-threaded end of stem 113. FIG. 7 shows plug 114 threadedly attached to stem 113 typical of the arrangement when sampling device 31 (or drill plug 95) is being retrieved from the auger sections.

Figure 7A:
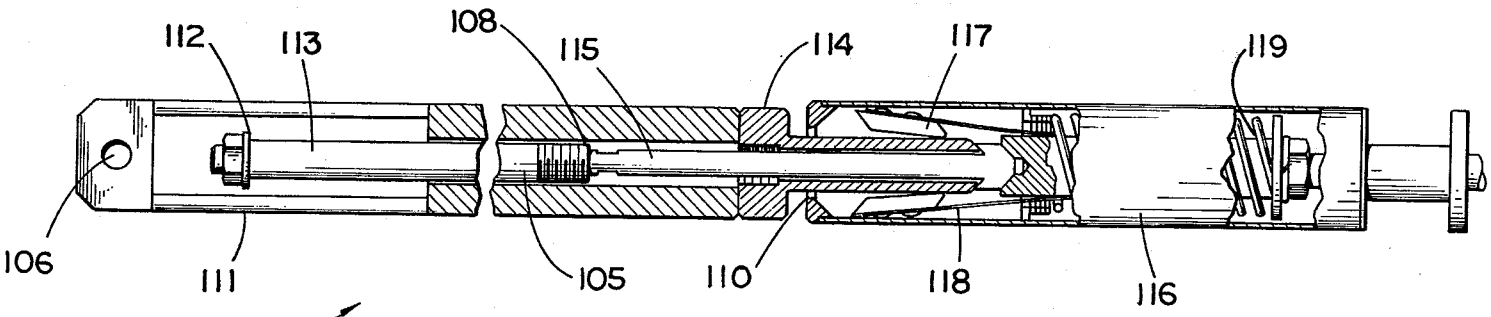
FIG. 7*a* is an elevational view of the FIG. 7 mechanism in an insertion mode.

Cable 27 is connected to ball bearing swivel 75 which is connected to opening 106 in weighted member 111 and cable 27 is used to lower sampling device 31 into the drilled hole. When sampling device 31 reaches the bottom of the hole, the weight of weighted member 111 will cause plug 114 to push through the blocks 117 which are positioned within housing 116 to the open position shown in FIG. 7*a*. When the cable 27 is reeled in, stem 113, plug 114 and probe 115 will remain in place (plug 114 is not threadedly attached to stem 113) until weighted member 111 contacts flange 112, then probe 115 will pass out of blocks 117 without catching, since blocks 117 are held open by plug 114. The cable 27 can be reeled in leaving either the drill bit plug 95 or the thin-walled sampling tube 69 locked in place at the bottom of the hole disconnected from cable 27. When the sampling device 31 is not suspended on cable 27, the coil spring 119 exerts a force which positions blocks 117 as shown in FIG. 7 and causes the latches 80 to expand outwardly. Blocks 117 are attached to leaf springs 118 which are secured to the cylindrical member which attaches to plunger 79 at one end and engages probe 115 at its opposite end. When the sampling device is suspended on cable 27 (such as during insertion of the sampling device), the weight of the sampling device compresses the coil spring 119 to a sufficient degree that blocks 117 partially pass through opening 110 and at which time the latches 80 are in a retracted position. This is the situation which exists while the sampling device is being lowered through the auger section(s). The close fit of the inner wall of the auger section(s) prevents latches 80 from expanding (in response to plunger 79) until the latches are in a position to properly lock into recesses 86. Blocks 117 remain in opening 110 until the latches expand, because of the fact that downward movement of plunger 79 is restricted until the latches expand. Additionally, blocks 117 cannot open while in opening 110 due to the closeness of the fit. Accidental release of the sampling device prior to the time it is properly seated and locked in place is prevented in part by the action of blocks 117. When the position of the recesses 86 in connector 65 is reached and cable 27 no longer bears the weight, the coil spring 119 exerts a force downwardly which causes blocks 117 to pass through opening 110 and at the same time latches 80 expand outwardly into recess 86. In order to retrieve the sampling device 31, plug 114 is threadedly attached to stem 113 and the end of probe 115 will catch blocks 117 thereby raising the sampling device 31 as the cable 27 is reeled in.

The present invention also includes the method of earth sampling described below associated with apparatus 10 whose operation has been described in detail above. The first step is to position over a desired drilling site the earth sampling apparatus 10, having rotary power means and a rotary head driver 18 connected thereto. Next hollow spindle 20 is positioned within rotary head driver 18 and the gimbal ring auger coupling 25 is connected to spindle 20 and to annular member 32. Auger section 21 is attached to the annular member 32 and drill bit plug 95 is lowered into auger sections 21 and **21*a* by means of cable 27. Once drill bit plug 95 is locked into position by means of locking portion 72 and latches 80, the rotary power means consisting of transmission 23 and gear housing 22 drive the rotary head driver 18 which rotates auger sections 21 and 21*a* and drill bit plug 95 thereby drilling a hole in the earth. Additional auger sections 21*b*, 21*c*, 21*d*, etc., can be attached as needed to reach the desired sampling depth. Once the hole is drilled, the rotary power means are turned off and the drill bit plug 95 is removed. Next, sampling device 31 is installed into the leading auger section, locked in place into connector 65 by latches 80 and the rotary power means is energized. As the auger sections 21, 21*a*, 21*b*, etc. rotate, hydraulic feed system 17 presses down on the mechanical combination of transmission 23, housing 22, and driver 18 which in turn exerts a downward force on the sampling device 31 effecting continuous and rapid penetration of the thin-walled sampling tube 69 into the sampled soil without twisting or turning. Once the soil sample is taken, retrieving the sample from the bottom of the hole is accomplished by means of reelable cable 27. If it is desired to disconnect cable 27 while drilling or obtaining the soil sample, overshot mechanism 104** is used.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. An earth sampling apparatus which comprises:

a drilling apparatus having rotary power means;

an auger section including a hollow tube with a helical flight secured thereto;

a hollow-centered drive shaft connected to said drilling apparatus;

a hollow-centered coupling connecting the drive shaft to the auger section;

a sampling device including a locking element bearingly connected to a thin-walled sampling tube in such a manner that as the locking element is rotated, the thin-walled sampling tube remains stationary;

reelable cable means connected between the drilling apparatus and the locking element of said sampling device and operable to move the sampling device through said hollow tube; and a latching mechanism on said locking element and hollow tube for rigidly securing the locking element of said sampling device to the hollow tube whereby downwardly-advancing rotation of said hollow tube produces downwardly-advancing motion of said thin-walled sampling tube.

2. The earth sampling apparatus of claim 1 in which the locking element of the sampling device comprises an overshot mechanism operable by the drilling apparatus to detach the cable from said sampling device and to reattach the cable thereto.

3. The earth sampling device of claim 1 wherein said hollow-centered coupling has a ring-shaped configuration and includes four bearing arrangements positioned at 90° intervals around said ring.

4. A method of core sampling comprising the steps of:

positioning a drilling apparatus having a rotary power means and a hollow driver connected thereto at a drilling site;

connecting a hollow-stem auger to the hollow driver by means of a hollow-centered coupling;

attaching a pilot bit plug to said hollow-stem auger;

operating said drilling apparatus and power means to rotate and advance said hollow-stem auger and cause said auger to drill a hole into the earth to a desired sampling depth;

removing said pilot bit plug from the hollow-stem auger;

inserting a sampling device through the hollow driver, hollow-centered coupling and auger to the bottom of the hole by means of a reelable cable;

locking the sampling device into the auger so that the sampling device extends beyond the lower end of said auger;

rotating the auger around the sampling device while moving the auger and sampling device downwardly to take a sample; and retrieving said sampling device with the soil sample therein from the bottom of the hole by means of said reelable cable.

5. The method of core sampling of claim 4 wherein said sampling device comprises a locking element and a thin-walled sampling tube bearingly connected to said locking element and the locking step is performed by lowering the sampling device to a position within the hollow-stem auger where a pair of expandable latches secure said locking element to the hollow auger.

6. The method of core sampling of claim 5 which comprises the additional steps of:

detaching said reelable cable from said sampling device subsequent to the locking step; and reattaching said reelable cable from said sampling device immediately prior to the retrieval of said soil sample.

* * * * *